US009639023B2

(12) United States Patent
Sato

(10) Patent No.: US 9,639,023 B2
(45) Date of Patent: May 2, 2017

(54) DEVELOPING ASSEMBLY AND IMAGE FORMING APPARATUS

(71) Applicant: CANON KABUSHIKI KAISHA, Tokyo (JP)

(72) Inventor: Shun Sato, Ashigarakami-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/732,872

(22) Filed: Jun. 8, 2015

(65) Prior Publication Data

US 2015/0362858 A1 Dec. 17, 2015

(30) Foreign Application Priority Data

Jun. 12, 2014 (JP) ..... 2014-121456

(51) Int. Cl.
*G03G 15/08* (2006.01)

(52) U.S. Cl.
CPC ..... *G03G 15/0812* (2013.01); *G03G 15/0815* (2013.01)

(58) Field of Classification Search
CPC ..... G03G 15/0812; G03G 15/065; G03G 15/0815; G03G 15/08
See application file for complete search history.

(56) References Cited

U.S. PATENT DOCUMENTS

2001/0048828 A1* 12/2001 Ishii ..... G03G 9/0825 399/281
2002/0136561 A1* 9/2002 Izumi ..... G03G 15/0806 399/44
2007/0177906 A1* 8/2007 Yamanaka ..... G03G 15/0812 399/279
2008/0220360 A1* 9/2008 Hasegawa ..... G03G 9/0835 430/109.3
2010/0028057 A1* 2/2010 Yamada ..... G03G 15/065 399/284

FOREIGN PATENT DOCUMENTS

JP H06-301281 A 10/1994

* cited by examiner

*Primary Examiner* — Francis Gray
(74) *Attorney, Agent, or Firm* — Fitzpatrick, Cella, Harper & Scinto

(57) ABSTRACT

A sliding member has a free end that extends toward the downstream side of the direction of rotation of a developer bearing member, and a tip portion on the free end side of the sliding member slides against the developer bearing member. The developer bearing member has a region where, when a developer is placed on a vertical direction upper side of the developer bearing member which is in a stationary state, the developer can remain without dropping. A position against which the tip portion of the sliding member slides, the region, and a position against which a regulating member slides are located on the developer bearing member in this order toward the downstream side of the direction of rotation of the developer bearing member.

20 Claims, 7 Drawing Sheets

DEVELOPING ASSEMBLY AND IMAGE FORMING APPARATUS

BACKGROUND OF THE INVENTION

Field of the Invention

The present invention relates to an image forming apparatus, such as a copier and a printer, which functions to form an image on a recording material such as a sheet, and particularly to a developing assembly equipped in these apparatuses.

Description of the Related Art

A conventional developing assembly of the following configuration has been known. The conventional developing assembly is configured with a developing roller that bears a developer thereon and develops an electrostatic latent image formed on a photoreceptor, a feed roller for feeding the developer to the developing roller, a regulating member for regulating the layer thickness of the developer on the developing roller, and a developer container for storing the developer (see Japanese Patent Application Publication No. H6-301281).

The feed roller comes into contact with the developing roller at a certain penetration level and rotates in the same direction as the developing roller. A sponge roller in which a sponge layer is provided around a metal core bar is used as the feed roller. This feed roller is configured such that the developer is once introduced to the sponge layer and then the developer inside the sponge layer is discharged and fed to the developing roller by compressing the sponge layer by contact with the developing roller.

With increased users' awareness of the environment in recent years, it is crucial to use the developer of the developer container as much as possible. The conventional configuration described above, however, has a concern that the developer present in the vicinity of the core bar of the sponge layer of the feed roller remains in the sponge layer without being discharged from the sponge layer to the developing roller. In order to reduce the unused developer remaining in the sponge layer, the developer needs to be fed to the developing roller without using the sponge roller.

In other words, a developing assembly and an image forming apparatus that are capable of efficiently using the developer of the assembly are desired.

SUMMARY OF THE INVENTION

A representative configuration disposed in this application is such that a developing assembly, comprising:

a rotatable developer bearing member for bearing a developer;

a sliding member that slides against the developer bearing member with the developer therebetween, so that the developer is borne by the developer bearing member; and a regulating member that regulates the amount of the developer borne on the developer bearing member by sliding against the developer bearing member with the developer therebetween, the developing assembly executing a development action on an image bearing member by using the developer, the amount of which is regulated by the regulating member, wherein the sliding member has a free end that extends toward a downstream side of a direction of rotation of the developer bearing member, a tip portion on the free end side of the sliding member slides against the developer bearing member, the developer bearing member has a region where, when the developer is placed on a vertical direction upper side of the developer bearing member which is in a stationary state, the developer can remain without dropping, and a position against which the tip portion of the sliding member slides, the region, and a position against which the regulating member slides are located on the developer bearing member in this order toward the downstream side of the direction of rotation of the developer bearing member.

Further features of the present invention will become apparent from the following description of exemplary embodiments (with reference to the attached drawings).

DESCRIPTION OF THE EMBODIMENTS

An exemplary embodiment for implementing the present invention is described hereinafter in detail with reference to the drawings. However, the sizes, materials and shapes of the components as well as the relative arrangements thereof illustrated in the embodiment are intended to be changed in accordance with the configuration of the apparatuses to which the present invention is applied and various conditions, and are not intended to limit the scope of the present invention to the embodiment. The present invention relates to a developing assembly that develops (visualizes) an electrostatic latent image (latent image) using a developer in an electrophotographic device or an electrostatic recorder.

Example 1

Example 1 is now described hereinafter.

<Image Forming Apparatus>

Figure 2:
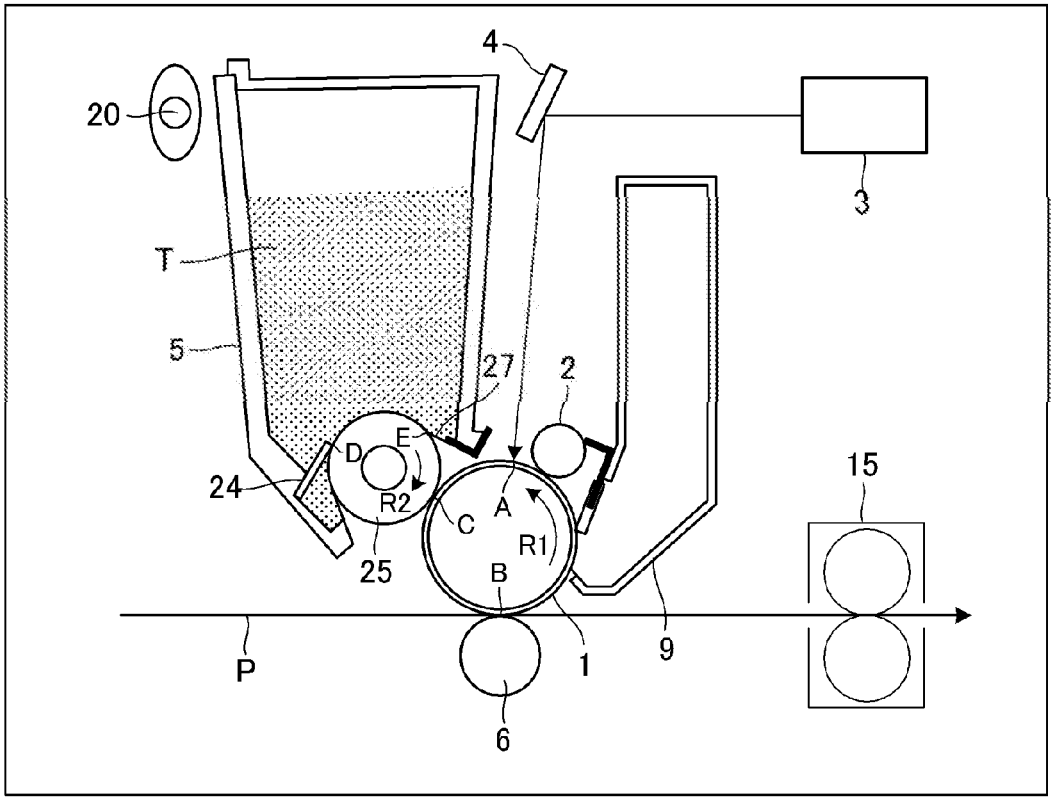
FIG. 2 is a schematic cross-sectional diagram of an image forming apparatus of Example 1.

FIG. 2 is a schematic cross-sectional diagram of an image forming apparatus according to the present example. The cross-sectional diagram illustrated in the present example is taken along a line perpendicular to the rotation axis of a photosensitive drum 1 (the rotation axis of a developing roller 25) that functions as an image bearing member.

As shown in FIG. 2, the photosensitive drum 1 is provided so as to be able to rotate in the direction represented by arrow R1. A charging roller 2, a developing assembly 5, a transfer roller 6, and a cleaning device 9 are disposed in this order around the photosensitive drum 1 in the direction of the arrow R1 shown in FIG. 2. An exposure device 3 is provided in order to emit a laser beam to irradiate an exposure position (located downstream of the charging roller 2 with respect to the direction of the arrow R1 and upstream of the developing assembly 5) A on the photosensitive drum 1 through a reflecting mirror 4, to form an electrostatic latent image on the surface of the photosensitive drum 1.

With this configuration, the operations of charging, exposure, development, transfer, and cleaning can be performed in this order as the direction of rotation of the photosensitive drum 1 shifts toward the downstream side (the details will be described hereinafter).

The charging roller 2 charges the surface of the photosensitive drum 1 uniformly. The developing assembly 5 stores (accommodates) a nonmagnetic one-component developer (toner) as the developer, and develops the electrostatic latent image formed on the surface of the photosensitive drum 1 into a developer image (performs a development action on the photosensitive drum 1). The developing assembly 5 is demountable from the image forming apparatus main body (the main body of the image forming apparatus). In this configuration, the developing assembly 5 may be formed as a cartridge.

The transfer roller 6 transfers the developer image formed on the surface of the photosensitive drum 1 to a recording material P. The cleaning device 9 removes the developer that is not transferred to the recording material P but remains on the photosensitive drum 1, and has a cleaning blade that is disposed in contact with the surface of the photosensitive drum 1 to scrape the developer off the photosensitive drum 1. A fixing apparatus 15 is also provided in order to fix the developer image onto the recording material P by applying heat and pressure to the recording material P to which the developer image is transferred.

<Image formation process>

An image formation operation of the image forming apparatus according to the present example is now described hereinafter.

First, the surface of the photosensitive drum 1 rotating at 100 mm/sec in the direction of the arrow R1 shown in FIG. 2 is charged to a predetermined potential by the charging roller 2. Next, a laser beam is emitted from the exposure device 3 in accordance with an image signal of each color and radiated onto the exposure position A on the photosensitive drum 1 through the reflecting mirror 4. As a result, an electrostatic latent image is formed on the photosensitive drum 1. The electrostatic latent image formed on the photosensitive drum 1 is developed by the developing assembly 5 at a development position C on the photosensitive drum 1 shown in FIG. 2. As a result, a developer image is formed on the photosensitive drum 1. The developer image formed on the photosensitive drum 1 is transferred to the recording material P by the transfer roller 6 at a transfer position B shown in FIG. 2. The recording material P to which the developer image is transferred is sent to the fixing apparatus 15, and then the fixing apparatus 15 applies pressure and heat to the developer image on the recording material P, thereby fixing the developer image onto the recording material P. In this manner, an image is formed on the recording material P.

<Developing Assembly>

Figure 1:
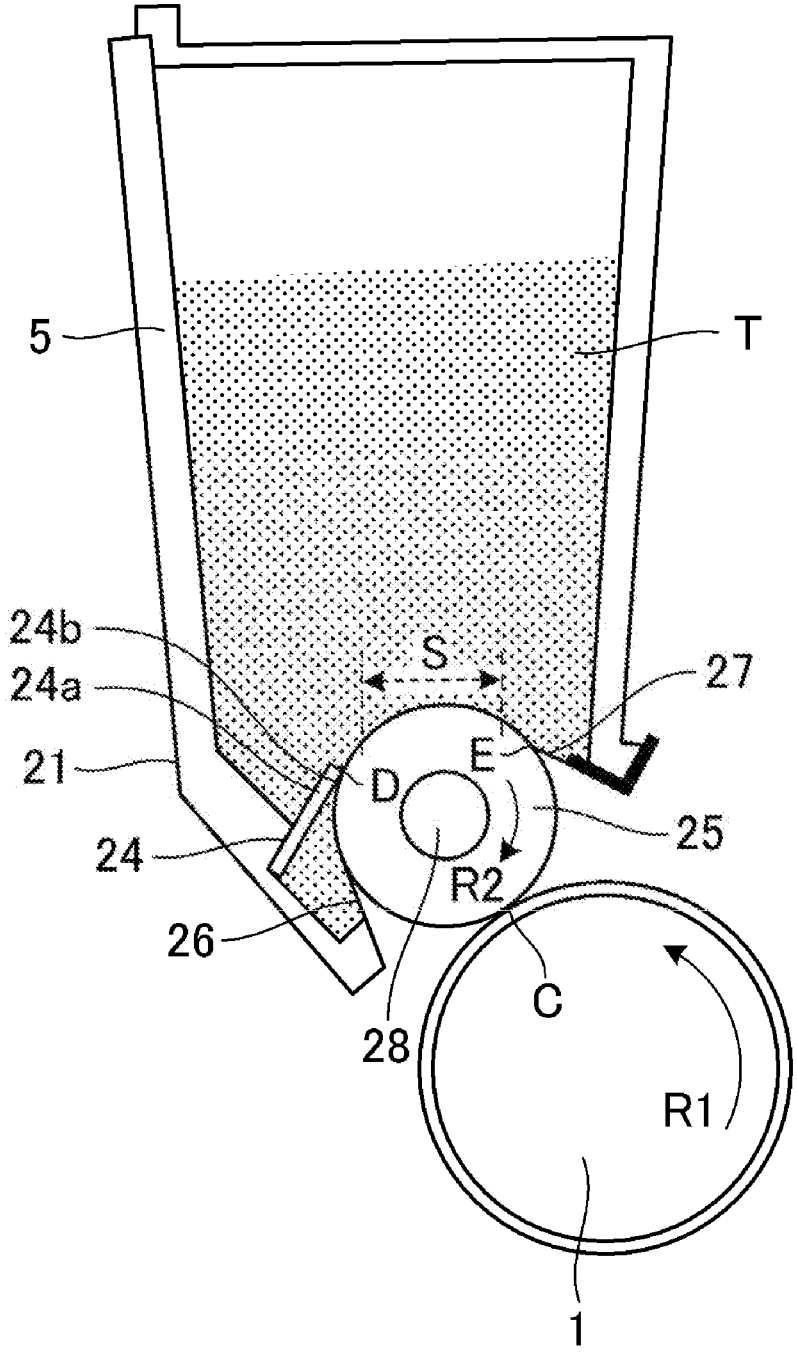
FIG. 1 is a schematic cross-sectional diagram for explaining the configuration of a developing assembly of Example 1 of the present invention.

FIG. 1 is a schematic cross-sectional diagram for explaining the configuration of the developing assembly 5 according to the present example. The developing assembly 5 of the present example is now described hereinafter in detail.

The developing assembly 5 has a developer container 21, the developing roller 25 as a rotatable developer bearing member, a regulating blade 27 as a regulating member, and a developer supply member 24 as a sliding member. The developer container 21 corresponds to a developer storage for storing a developer T, and the space inside the developer storage corresponds to a developer storage space. The developing roller 25 bears the developer T and is located at an opening provided at the lower part of the developer container 21. The developer supply member 24, provided in contact with the developing roller 25, rubs (slides or slide-contacts against) the developing roller 25 to cause the developing roller 25 to bear the developer. The regulating blade 27 rubs the developing roller 25, with the developer therebetween, to regulate (limit, control) the amount (thickness, layer thickness) of the developer T borne on the developing roller 25.

In this configuration, the developing assembly 5 supplies the photosensitive drum 1 with the developer T that is borne on the developing roller 25 and has the amount thereof regulated by the regulating blade 27.

During the development operation, the developing roller 25 rotates while in contact with the photosensitive drum 1. After completion of the development operation, a cam 20 (see FIG. 2) provided in the image forming apparatus main body rotates to push the upper portion of the developer container 21, separating the developing roller 25 from the photosensitive drum 1. After being separated from the photosensitive drum 1, the rotary drive of the developing roller 25 is stopped by control performed by drive control means of the image forming apparatus main body.

The developing roller 25 is made from a conductive core bar 28 having a diameter of 8 (mm) and a conductive elastic layer, the base layer of which is configured with silicon rubber formed around the conductive core bar 28. The surface layer of the developing roller 25 is coated with an acrylic urethane-based rubber layer. The developing roller 25 has an outer diameter of 13 (mm) and a volume resistivity of approximately $10^5$ Ω·cm. During the development operation, the developing roller 25 is supported by the developer container 21 so as to be able to come into contact with the photosensitive drum 1 at the development position C and rotate in the direction represented by arrow R2 shown in FIG. 1. During the image formation operation, the peripheral speed of the developing roller 25 is 160 mm/sec.

The regulating blade 27 is made of flexible stainless steel (SUS) and has one end fixed to a support sheet metal and has the other end in contact with the developing roller 25 at a contact position (sliding portion, or "developer amount regulating position," hereinafter) E as a free end. The support sheet metal is fixed to the developer container 21. The regulating blade 27 is positioned in such a manner that a smooth surface thereof in the vicinity of the free end rubs the surface of the developing roller 25 at the developer amount regulating position E, with the developer therebetween, in a direction opposite to the direction of rotation of the developing roller 25 (the direction of the arrow R2).

The developer supply member 24 is configured with a 0.25-mm thick flexible sheet member made of polyphenylene sulfide resin.

The developer supply member 24 has one end fixed to the developer container 21 as a fixed end and has the other end formed as a free end 24*a*. The free end 24*a*is stretched from the fixed end toward the downstream side of the direction of rotation of the developing roller 25. In the present example, the developer supply member 24 is disposed in such a manner that its one end is fixed to the developer container 21 and the free end 24a is located downstream of the direction of rotation of the developing roller 25 with respect to the one end (fixed end).

A tip portion 24*b* (see FIG. 7A) of the free end 24a (free end side) of the developer supply member 24 is configured to come into contact with the surface of the developing roller 25 at a developer supply position shown in FIG. 1 (a sliding portion, or "nip portion," hereinafter) D, with the developer therebetween. For this reason, as the developing roller 25 rotates, the developing roller 25 and the developer supply member 24 rub each other at the nip portion D, with the developer therebetween.

It is preferred that the contact pressure (pressure) between the developing roller 25 and the developer supply member 24 be equal to or higher than 20 gf/cm and equal to or lower than 50 gf/cm, and that the nip width (the width in a direction perpendicular to the direction of the rotation axis (longitudinal direction) of the developing roller 25 at the nip portion) therebetween be equal to or greater than 300 μm and equal to or less than 800 μm. Contact pressure less than 20 gf/cm brings concern that the image quality drops, and contact pressure greater than 50 gf/cm brings concern that the developer that remains on the surface of the developing roller 25 in the development operation does not return to (is not recovered by) the developer container. Nip width less than 300 μm brings concern that the developer that remains on the surface of the developing roller 25 in the development operation does not return to the developer container, and nip width greater than 800 μm brings concern that the image quality drops. A decrease in image quality mentioned in the present example occurs especially when a continuous solid black image is formed. Note that 1 gf/cm=$9.8\times10^{-1}$ N/m.

In the present example, the more favorable value of the contact pressure is 40 gf/cm and the more favorable value of the nip width including the ridge line of the angle portion of the tip portion 24*b* on the free end 24*a* side is 500 μm.

The developing assembly 5 is also provided with a leak prevention seal 26 as a sealing member for covering (sealing) the gap between the developing roller 25 and the developer container 21. The developer supply member 24 may serve as the leak prevention seal 26.

The present example is characterized by the positional relationship between the regulating blade 27 and the developer supply member 24. As will be described hereinafter in detail, the regulating blade 27 and the developer supply member 24 are disposed to sandwich at least a region S of the developer supply member 24 where the developer is placed.

<The Region where the Developer is Placed>

Next, a method for defining the region S on the developing roller 25 where the developer is placed is described with reference to FIGS. 3A and 3B.

Figure 3A:
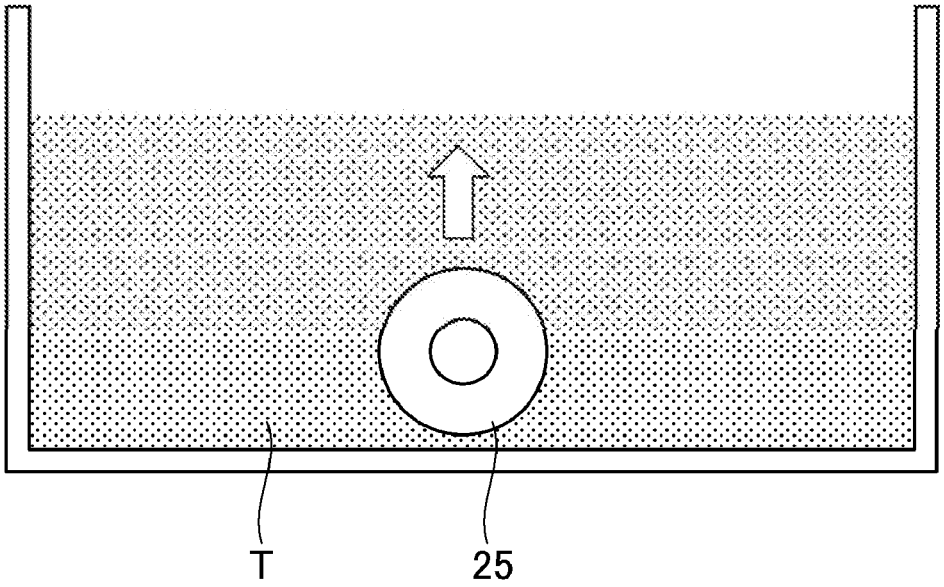
FIGS. 3A and 3B are each a diagram for explaining a method according to Example 1 for defining a region in a developing roller where a developer is placed.
Figure 3B:
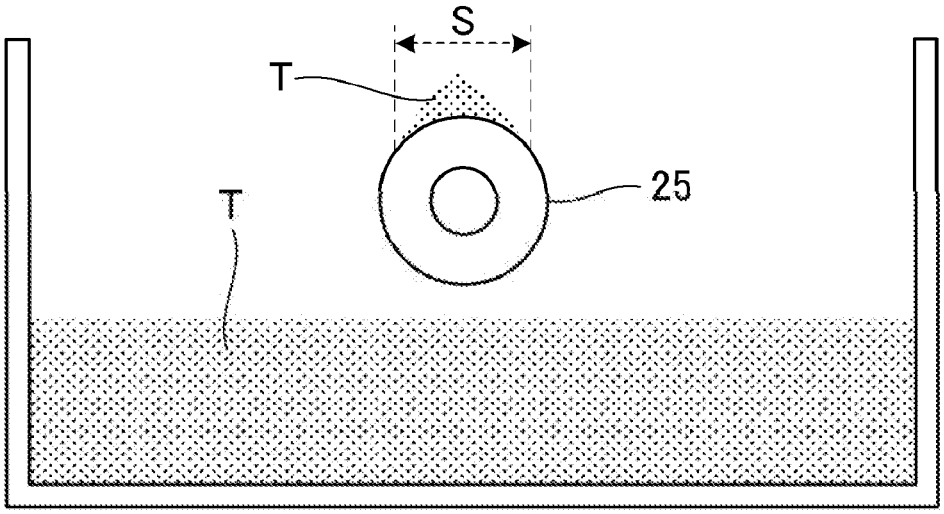

FIGS. 3A and 3B are each a diagram for explaining the method for defining the region S on the developing roller 25 where the developer is placed.

In a preparatory step, a container is filled with the developer T in which the developing roller 25, in a stationary state, is immersed substantially horizontally, as shown in FIG. 3A. The present example uses 200 g of developer T. In the next step, the developing roller 25 is slowly lifted vertically (perpendicularly upward) while keeping the substantially horizontal state thereof, as shown in FIG. 3B. The speed of lifting the developing roller 25 is approximately 1 cm/sec, for example, at which the developer T does not spatter.

At this moment, there exists the region on the developing roller 25 (on the developer bearing member, the upper side of the developer bearing member in the vertical direction) where the developer T can remain without dropping (the region on the developing roller 25 where the developer T is likely to remain), and in the present example this region is defined as "region S" where the developer is placed.

This region S represents the region where the weight of the developer T is constantly applied to the developing roller 25, but this is not the only method to determine the region S. For example, the region S may be a region on the developing roller 25 where the developer T stays when poured from above the developing roller 25. Also, this region S changes depending on the developer T or the diameter or surface condition of the developing roller 25. The region S is likely to expand when the attachment force between the developer T and the developing roller 25 increases or when the angle of repose of the developer T becomes low. In the present example, the region S has the width of the surface of the developing roller 25 in the horizontal direction, which is approximately 8 mm.

<Development Process>

The developer T stored in the developer container 21 is fed to the developing roller 25 at the nip portion D by the developer supply member 24. As a result, the developer attached to the surface of the developing roller 25 is carried to the developer amount regulating position E shown in FIG. 1 as the developing roller 25 rotates, and the amount of the developer T is regulated to an appropriate amount by the regulating blade 27. At the development position C, the developer on the surface of the developing roller 25 is used for the development (visualization) of the electrostatic latent image formed on the surface of the photosensitive drum 1. The developer which has not been used for the development and remains on the surface of the developing roller 25 is returned to the developer container 21.

<Developer Supply Process>

Next is described a method for supplying the developer to the developing roller 25 using the developer supply member 24.

In order to supply the developer to the developing roller 25, the developer with an electrical charge needs to be brought into contact with the developing roller 25. Therefore, the developer is triboelectrically charged by the pressure inside the nip portion D by causing the developer supply member 24 and the developing roller 25 to slide against each other with the developer placed in the nip portion D between the developer supply member 24 and the developing roller 25, whereby an electrical charge is applied to the developer. This electrically charged developer is then supported on the surface of the developing roller 25 by image force between the developer and the developing roller 25.

The inventors of the present invention have also discovered that more developer can be fed to the developing roller 25 by causing the developer with no electrical charge to come into contact with the developing roller 25 while applying pressure thereto, by means of the electrically charged developer borne on the surface of the developing roller 25.

Because the developer with no electrical charge is born by the developing roller 25 by being brought into contact therewith by the electrically charged developer, even the developer that is not applied with an electrical charge at the nip portion D can be supplied to the developing roller 25. The present example utilizes the effect in which the developer is shifted to the developing roller 25 by its own weight. In other words, the developer that is applied with an electrical charge at the nip portion D has its amount regulated by the regulating blade 27 after passing through the region S on the developing roller 25 where the weight of the developer is constantly applied as described above.

Specifically, in the present example, the developer supply member 24 and the regulating blade 27 are disposed with the region S therebetween. More specifically, the nip portion D and the developer amount regulating position E are disposed with the region S therebetween, in which, in relation to the region S, the nip portion D is located upstream of the direction of rotation of the developing roller 25, whereas the developer amount regulating position E is located downstream of the direction of rotation of the developing roller 25. In this manner, more developer can be supplied favorably to the developing roller 25.

<Validation 1>

Next, how the effects of the present example are validated is described with reference to FIGS. 4A to 4D.

Figure 4A:
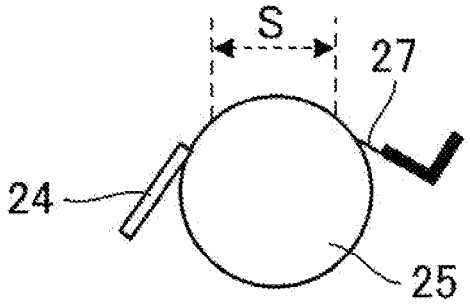
FIGS. 4A to 4D are each a diagram for explaining how the effects of Example 1 are validated.
Figure 4B:
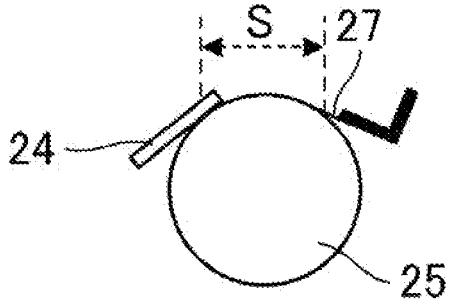
Figure 4C:
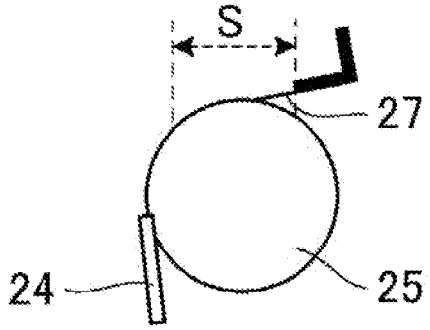
Figure 4D:
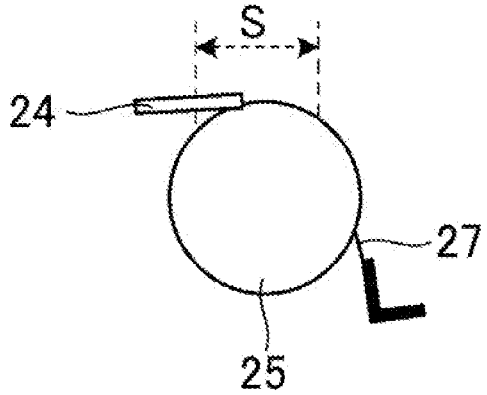

FIGS. 4A to 4D are each a diagram showing the positional relationship among the developing roller 25, the regulating blade 27, and the developer supply member 24. FIG. 4A shows the configuration of the present example, and FIGS. 4B to 4D show the configurations of comparative examples that are different from the present example in terms of the locations of the regulating blade 27 and the developer supply member 24 in relation to the developing roller 25. In each of these configurations, the developer is stored above the developing roller 25 and then supplied to the surface of the developing roller 25 using the gravity.

The space between the developer supply member 24 and the regulating blade 27 in the circumferential direction of the developing roller 25 is compared with the region S hereinafter. The space between the developer supply member 24 and the regulating blade 27 in the circumferential direction of the developing roller 25 is equivalent to the space between the nip portion D and the developer amount regulating position E, and is referred to as "D-E space," hereinafter.

In the configuration of the present example shown in FIG. 4A, the region S is located between the regulating blade 27 and the developer supply member 24, and the D-E space is wider than the region S. In the configuration of Comparative Example 1 shown in FIG. 4B, the space between the regulating blade 27 and the developer supply member 24 is narrower than that of the present example, and the D-E space is narrower than the region S. In the configuration of Comparative Example 2 shown in FIG. 4C, the locations of the regulating blade 27 and the developer supply member 24 are shifted toward the upstream side of the direction of rotation of the developing roller 25 as compared to the present example, and the D-E space is wider than the region S, in which the regulating blade 27 penetrates the region S. In the configuration of Comparative Example 3 shown in FIG. 4D, the locations of the regulating blade 27 and the developer supply member 24 are shifted toward the downstream of the direction of rotation of the developing roller 25 as compared to the present example, and the D-E space is wider than the region S, in which the developer supply member 24 penetrates the region S.

In the present example and Comparative Examples 1, 2 and 3, a whole white image was printed on one hundred sheets of paper, two sheets at a time, which were then compared with an image that has output a whole black image. The results are shown in Table 1. The configurations with no image density non-uniformity were evaluated as "○," and the configurations with image density non-uniformity that could be problematic in practical use were evaluated as "×."

TABLE 1

| Configuration | Evaluation of Image |
|---|---|
| Example 1 | ○ |
| Comparative Example 1 | x |
| Comparative Example 2 | x |
| Comparative Example 3 | x |

In the present example, because the region S was located between the regulating blade 27 and the developer supply member 24, the amount of developer supplied was enough that the image quality did not drop.

In Comparative Example 1, the space between the regulating blade 27 and the developer supply member 24 was narrower than that of the configuration of the present example, and the D-E space was narrower than the region S. Therefore, the amount of developer supplied was low, which caused a decrease in image quality.

In Comparative Examples 2 and 3, the space between the regulating blade 27 and the developer supply member 24 was equivalent to that of the present example. However, unlike the present example, the region S is not located between the regulating blade 27 and the developer supply member 24. Because the force required to adhere the developer to the developing roller 25 did not act in the region other than the region S in the surface of the developing roller 25, the developer could not be supplied favorably to the developing roller 25, which caused a deficiency of the developer and hence a decrease in image quality. It was, therefore, validated that placing the regulating blade 27 and the developer supply member 24 to have the region S therebetween can supply the developer to the developing roller 25 more favorably while preventing a decrease in image quality.

As described above, according to the present example, the following effects can be achieved. In other words, bringing the tip portion 24*b* of the developer supply member 24 into contact with the developing roller 25 enables supply of the developer to the developing roller 25 without using the conventional developer feed roller that is provided with a sponge layer for supplying a developer to the developing roller 25. In addition, the configuration without such a sponge roller can prevent the developer from remaining in the sponge layer. Therefore, more effective use of the developer can be realized.

Furthermore, in the present example, placing the region S between the regulating blade 27 and the developer supply member 24 enables supply of the developer to the developing roller 25 while preventing a decrease of image quality.

Moreover, the developing assembly can be provided at a lower cost by eliminating such a conventional developer feed roller. Eliminating the developer feed roller can also lead to a reduction in size of the developing assembly.

The present example uses a spheronized, nonmagnetic one-component developer as the developer. The use of the spheronized developer can realize a low angle of repose and ensure a wide region S, enabling easier supply of the developer to the developing roller 25.

In the present example, a 0.25-mm thick sheet member made of polyphenylene sulfide resin is used as the developer supply member 24; however, the developer supply member 24 is not limited thereto, and therefore a film made of polyphenylene sulfide, polyethylene terephthalate or the like can be used. The thickness of the developer supply member 24, too, is not limited to 0.1 mm; thus, the developer supply member 24 may have any thickness as long as a desired contact pressure can be ensured when the developing roller 25 is pressed. Moreover, a reduction in size of the developing assembly and the number of parts thereof can be achieved by configuring the leak prevention seal 26 for covering the gap between the developing roller 25 and the developer container 21 and the developer supply member 24 with the same component, or, in other words, by using the developer supply member 24 as the leak prevention seal 26.

The present example has described that a nonmagnetic one-component developer is used as the developer; however, the developer is not limited thereto. Any developer can be used as long as it comes into contact with the developing roller 25 by its own weight and is thereby fed to the developing roller 25.

The positional relationship between a developer surface and the developing roller 25 is now described.

In the present example, the developer surface (an interface or a surface (upper surface, front surface) of the stored developer) is located above the developing roller 25. With this configuration, the development operation can be executed while the region S is filled with the developer. In the present example, in order to fill the region S with the developer, the developer container 21 is configured in such a manner that the developer is stored in the region in the surface of the developing roller 25, which includes the nip portion D, the developer amount regulating position E, and the region S. In other words, the region in the surface of the developing roller 25, including the nip portion D, the developer amount regulating position E, and the region S, configures a part of the developer storage space.

<Validation 2>

Hereinafter, how the effects of placing the developer surface above the developing roller 25 are validated is explained with reference to FIGS. 5A and 5B.

Figure 5A:
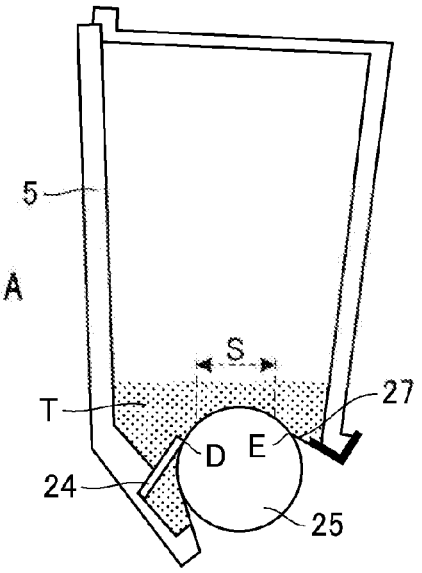
FIGS. 5A and 5B are each a diagram for explaining how the effects of Example 1 are validated.
Figure 5B:
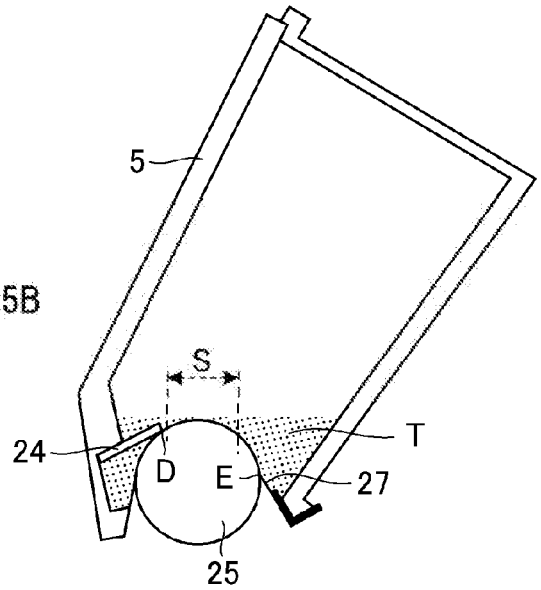

FIGS. 5A and 5B are schematic cross-sectional diagrams showing the configuration of the developing assembly 5. FIGS. 5A and 5B show different states of the developer surface.

The developing assembly 5 shown in FIG. 5A is low on developer, but the developer is still present around the developing roller 25 and region S.

The developing assembly 5 has a developer contact/separation mechanism, as described above. In the developing assembly 5 shown in FIG. 5B, the developer contact/separation mechanism is away from the developing assembly 5 of FIG. 5A, tilting the developing assembly 5. Consequently, the developing assembly 5 shown in FIG. 5B forms a developer surface that is different from that of the developing assembly 5 shown in FIG. 5A.

Hereinafter, the state of the developing assembly 5 shown in FIG. 5A is described as Example 1, and the state of the developing assembly 5 shown in FIG. 5B is described as Comparative Example 4.

Figure 7A:
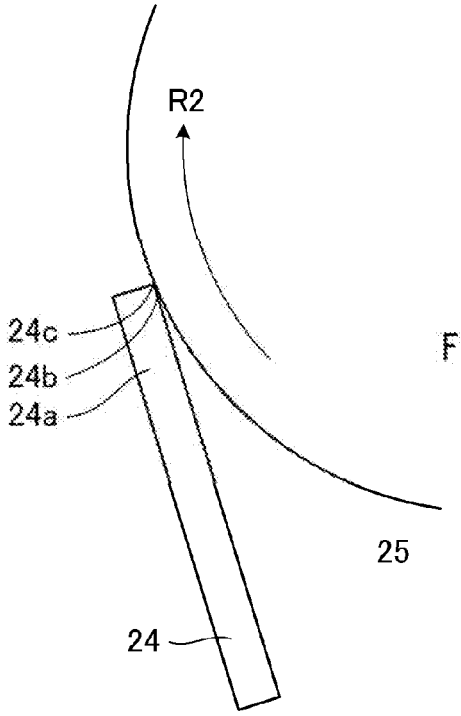
FIGS. 7A and 7B are each a diagram for explaining a developer supply member of Examples of the present invention.
Figure 7B:
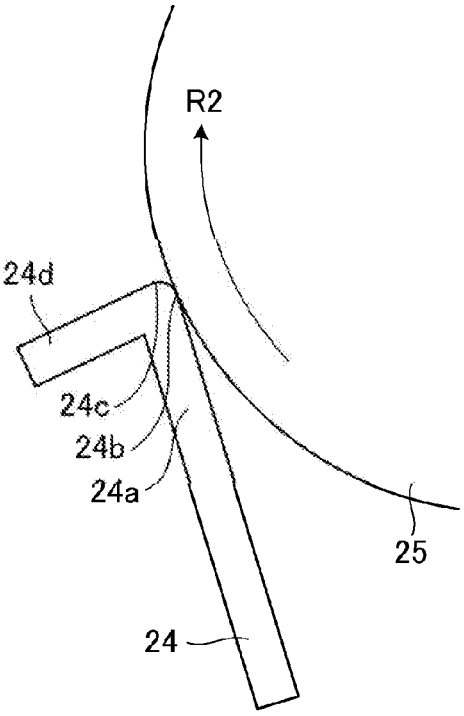

For comparison, the image forming apparatus main body was tilted intentionally so that the developing assembly 5 would be positioned as shown in FIG. 7B during the development operation, and image formation evaluation was executed for Comparative Example 4. The output images obtained in Example 1 and Comparative Example 4 were evaluated in the same manner as in Validation 1, and the results thereof are shown in Table 2.

TABLE 2

| Configuration | Evaluation of Image |
|---|---|
| Example 1 | ○ |
| Comparative Example 4 | x |

As shown in Table 2, while a normal image was output in Example 1, the image quality of Comparative Example 4 has dropped. This depends on whether the developer T is present in the region S or not. In Comparative Example 4, the space between the regulating blade 27 and the developer supply member 24 is the same as that of Example 1, and the regulating blade 27 and the developer supply member 24 are disposed to have the region S therebetween. However, compared to Example 1, the developer surface has changed as a result of tilting the developing assembly 5 and the developer T is not substantially present in the region S, whereby the ability to supply the developer has been deteriorated and the image quality has dropped.

Therefore, a decrease in image quality can be prevented by executing the development operation in the state of Example 1 in which the developer layer is located above the developing roller 25 and the region S is filled with the developer.

Accordingly, the posture of the developing assembly 5 may be changed as long as the developer surface is located above the developing roller 25 and the region S is filled with the developer when the development operation is executed.

The present example has described an aspect in which the developer container 21 is tiled by the developer contact/separation mechanism, and the same applies to a configuration in which the posture of the developing assembly 5 changes in a rotary manner, for example.

<Modification>

Figure 6:
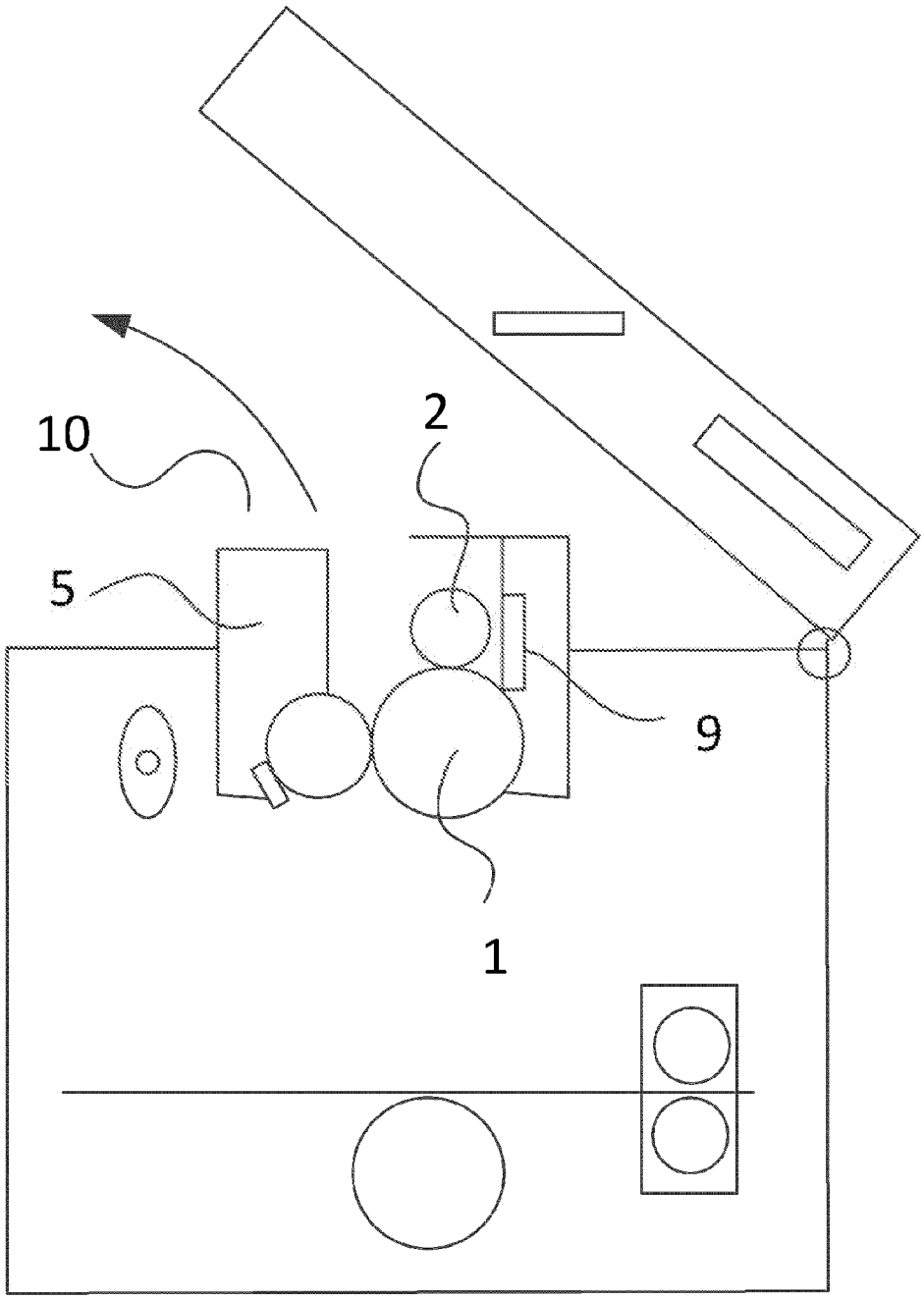
FIG. 6 is a schematic cross-sectional diagram for explaining a modification of Example 1.

FIG. 6 is a schematic cross-sectional diagram for explaining a modification. The present example has described that the developing assembly 5 is demountable from the image forming apparatus main body. However, as shown in FIG. 6, the developing assembly 5 may be integrated with the photosensitive drum 1 to configure a cartridge (process cartridge) 10, in which, as a part of the cartridge 10, the developing assembly 5 is configured to be demountable from the image forming apparatus main body. Furthermore, as process means that acts on the photosensitive drum 1, the cartridge 10 may be configured by integrating at least the charging roller 2 or the cleaning device 9 with the developing assembly 5 and the photosensitive drum 1. Alternatively, the developing assembly 5 may be fixed to the image forming apparatus main body so that a user cannot demount the developing assembly 5.

Example 2

Example 2 is now described hereinafter. The present example only describes the components different from those of Example 1; thus, the descriptions of the same components as those of Example 1 are omitted accordingly.

The present example is characterized in that the developer supply member 24 is provided with a reinforcing portion for reinforcing the tip portion 24*b* at the free end 24*a* side, in which the reinforcing portion is provided with a curvature corresponding to the shape of the free end 24*a* of the developer supply member 24.

FIGS. 7A and 7B are schematic diagrams for explaining the developer supply member 24, showing the nip portion D between the developer supply member 24 and the developing roller 25. FIG. 7A shows the configuration of Example 1, and FIG. 7B shows the configuration of the present example.

In the configuration of Example 1, the free end 24*a* of the developer supply member 24 configured with a sealing member is in contact with the developing roller 25, as shown in FIG. 7A.

In the configuration of the present example, on the other hand, the tip portion 24*b* on the free end 24*a* side of the developer supply member 24 is provided with a bent portion 24*d* that is bent 90 degrees, as shown in FIG. 7B. The bent portion 24*d* is a part that is bent 90 degrees with respect to the tip portion 24*b* on the free end side of the developer supply member 24. In other words, the bent portion 24*d* extends from the tip portion 24*b* (the part (region) including a tip (edge) 24*c*) in the direction opposite from the developing roller 25.

Forming the bent portion 24*d* in the developer supply member 24 can enhance the strength of the developer supply member 24. The bent portion 24*d* can prevent deflection (corrugation) of the developer supply member 24, or the tip portion 24*b* of the developer supply member 24 in particular, the deflection being caused when the developer supply member 24 is attached to the developer container 21.

As long as the contact conditions of Example 1 are satisfied in this manner, the same effects as those of Example 1 can be achieved even when the curvature corresponding to the shape of the tip portion is provided as described in the present example. Curvature radius of approximately 0.5 R (0.5 mm) or less can achieve a desired contact pressure and hence the foregoing effects. However, the curvature radius is not limited thereto because the contact pressure is affected by the surface condition of the developing roller 25 and the grain diameter and shape of the developer.

In addition, according to the present example, the curvature is formed by bending the developer supply member 24, but the method for forming the curvature is not limited to bending the developer supply member 24. In the present example, the tip portion 24*b* is bent 90 degrees, but the tip portion 24*b* may be bent into an obtuse angle or an acute angle as well.

As described above, the present example can achieve the following effects by forming the bent portion in advance, in addition to the same effects as those of Example 1. In other words, not only is it possible to enhance the strength of the developer supply member 24, but also the shape of the contact region (the tip portion 24*b*) between the developer supply member 24 and the developing roller 25 can be made more stable than that of Example 1. Therefore, even when the developing assembly 5 is used over a long period of time (endurance time), the present example can prevent, more effectively than Example 1, wear and deformation of the developer supply member 24 that can be caused by the rubbing between the developer supply member 24 and the developing roller 25. Consequently, more stable supply of the developer can be realized.

Moreover, bending the developer supply member 24 as described in the present example prevents not only the occurrence of deflection (corrugation) of the developer supply member 24, which is caused when the developer supply member 24 is attached to the developer container 21, but also longitudinal irregularity of supply of the developer.

The present example has described an aspect in which the bent portion 24*d* is formed as a reinforcing portion in the developer supply member 24; however, the configuration of the present example is not limited thereto. In other words, any reinforcing portion may be provided as long as it can reinforce the tip portion 24*b* on the free end 24*a* side of the developer supply member 24 and especially prevent the occurrence of deflection in the developer supply member. In addition, the location for forming the reinforcing portion is also not limited to the tip portion 24*b* on the free end 24*a* side of the developer supply member 24.

Finally, the effects of each of the foregoing examples are summarized below. According to each of the foregoing examples, a developing assembly and an image forming apparatus that are capable of efficiently using the developer of the assembly can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-121456, filed Jun. 12, 2014, which is hereby incorporated by reference herein in its <or their, if more than one> entirety.

What is claimed is:

1. A developing assembly, comprising:

a rotatable developer bearing member for bearing a developer;

a sliding member that slides against the developer bearing member with the developer therebetween, so that the developer is borne by the developer bearing member; and a regulating member that regulates the amount of the developer borne on the developer bearing member by sliding against the developer bearing member with the developer therebetween, the developing assembly executing a development action on an image bearing member by using the developer, the amount of which is regulated by the regulating member, wherein the sliding member has a free end that extends toward a downstream side of a direction of rotation of the developer bearing member, and a tip portion that is provided on the free end of the sliding member and slides against the developer bearing member, the developer bearing member has a first region where, when the developer is placed on a vertical direction upper side of the developer bearing member which is in a stationary state, the developer can remain without dropping, and a position against which the tip portion of the sliding member slides, the first region, and a position against which the regulating member slides are located on the developer bearing member in this order toward the downstream side of the direction of rotation of the developer bearing member during execution of the development action.

2. The developing assembly according to claim 1, wherein the sliding member is provided with a reinforcing portion for reinforcing the tip portion of the sliding member.

3. The developing assembly according to claim 2, wherein the reinforcing portion extends from the tip portion on the free end of the sliding member in a direction opposite from the developer bearing member.

4. The developing assembly according to claim 3, wherein the reinforcing portion is formed by bending the free end of the sliding member.

5. The developing assembly according to claim 1, wherein the sliding member is a flexible sheet member.

6. The developing assembly according to claim 1, wherein the sliding member comes into contact with the developer bearing member at a pressure equal to or higher than 20 gf/cm and equal to or lower than 50 gf/cm.

7. The developing assembly according to claim 1, wherein a nip width between the sliding member and the developer bearing member in the direction of rotation of the developer bearing member is equal to or greater than 300 mm and equal to or less than 800 mm.

8. The developing assembly according to claim 1, wherein a second region in a surface of the developer bearing member, which includes a position where the developer bearing member and the sliding member slide against each other, the first region, and a position where the developer bearing member and the regulating member slide against each other, configures a part of a developer storage space.

9. The developing assembly according to claim 8, further comprising a sealing member for sealing a gap between the developer bearing member and a developer storage having the developer storage space, wherein the sealing member is disposed so as to slide against the developer bearing member at a position upstream of the tip portion of the sliding member in the direction of rotation of the developer bearing member.

10. The developing assembly according to claim 8, wherein the sliding member serves as a sealing member for sealing a gap between the developer bearing member and a developer storage having the developer storage space.

11. The developing assembly according to claim 1, wherein the developer is a nonmagnetic one-component developer.

12. The developing assembly according to claim 1, which is demountable from an apparatus main body of an image forming apparatus.

13. The developing assembly according to claim 12, which is demountable from the apparatus main body of the image forming apparatus as a part of a cartridge having the image bearing member.

14. An image forming apparatus, comprising:

an image bearing member; and the developing assembly of claim 1 that executes a development action on the image bearing member.

15. A developing assembly, comprising:

a rotatable developer bearing member for bearing a developer;

a sliding member that slides against the developer bearing member with the developer therebetween, so that the developer is borne by the developer bearing member; and a regulating member that regulates the amount of the developer borne on the developer bearing member by sliding against the developer bearing member with the developer therebetween, the developing assembly executing a development action on an image bearing member by using the developer, the amount of which is regulated by the regulating member, wherein the sliding member has a free end that extends toward a downstream side of a direction of rotation of the developer bearing member, and a tip portion that is provided on the free end of the sliding member and slides against the developer bearing member, the developer bearing member has a first region where, when the developer is placed on a vertical direction upper side of the developer bearing member which is in a stationary state, the developer can remain without dropping, and wherein the first region is located entirely between the tip portion of the sliding member and the regulating member, with the regulating member located downstream from the first region in the direction of rotation of the developer bearing member during execution of the development action.

16. The developing assembly according to claim 15, wherein the sliding member is provided with a reinforcing portion for reinforcing the tip portion of the sliding member.

17. The developing assembly according to claim 16, wherein the reinforcing portion extends from the tip portion on the free end of the sliding member in a direction opposite from the developer bearing member.

18. The developing assembly according to claim 17, wherein the reinforcing portion is formed by bending the free end of the sliding member.

19. The developing assembly according to claim 15, wherein a second region in a surface of the developer bearing member, which includes a position where the developer bearing member and the sliding member slide against each other, the first region, and a position where the developer bearing member and the regulating member slide against each other, configures a part of a developer storage space.

20. The developing assembly according to claim 19, further comprising a sealing member for sealing a gap between the developer bearing member and a developer storage having the developer storage space, wherein the sealing member is disposed so as to slide against the developer bearing member at a position upstream of the tip portion of the sliding member in the direction of rotation of the developer bearing member.

* * * * *